United States Patent [19]

Kawawa et al.

[11] 3,974,559

[45] Aug. 17, 1976

[54] CONTINUOUS CASTING PROCESS

[75] Inventors: Takaho Kawawa, Tokyo; Tohru Arimura, Yokohama; Masaru Okado, Tokyo, all of Japan

[73] Assignee: Nippon Kokan Kabushiki Kaisha, Tokyo, Japan

[22] Filed: Mar. 21, 1974

[21] Appl. No.: 453,276

[30] Foreign Application Priority Data

Mar. 26, 1973 Japan ..... 48-33507

[52] U.S. Cl. ..... 29/527.7; 164/82

[51] Int. Cl.[2] ..... B22D 11/16

[58] Field of Search ..... 164/76, 82, 270, 282; 29/527.7

[56] References Cited

UNITED STATES PATENTS

| | | | |
|---|---|---|---|
| 770,130 | 9/1904 | Trotz | 164/270 |
| 3,491,823 | 1/1970 | Tarmann et al. | 164/76 |
| 3,812,900 | 5/1974 | Bollig et al. | 164/270 X |

FOREIGN PATENTS OR APPLICATIONS

| | | | |
|---|---|---|---|
| 452,799 | 5/1968 | Switzerland | 164/282 |
| 766,584 | 1/1957 | United Kingdom | 164/76 |

*Primary Examiner*—Ronald J. Shore
*Assistant Examiner*—Gus T. Hampilos
*Attorney, Agent, or Firm*—Moonray Kojima

[57] ABSTRACT

In the withdrawing stage following the secondary cooling zone, each pair of rolls of a plurality of pairs of rolls reduces the cross section less than 1.5 percent at the portion between the liquidus line and solidus one in unsolidified phase, thereby to produce a sound cast piece without producing the known center segregation and the known center porosity.

1 Claim, 10 Drawing Figures

[S]%
0.040
0.030
0.020
0.010
Ladle analysis
C 0.13% P 0.013%
Si 0.22% S 0.017%
Mn 0.62% T.Al 0.007%
0.088
0.067
Investigating place
Center segregation line
200mm
800mm
1600mm
[S]%
[C]%
[C]%
0.30
0.25
0.20
0.15
0.10
100
80
60
40
20
0
20
40
60
80
100
Top side
Bottom side
Thickness of slab (mm)

CONTINUOUS CASTING PROCESS

The present invention relates to an improvement of the continuous casting process, and more particularly obtaining a cast piece showing sound quality without producing center segregation and center porosity.

Various proposals have heretofore been made for continuously casting liquid steel. Said continuous casting comprises casting zone, secondary cooling zone and withdrawing stage. First, in the casting zone, liquid steel is cast into a cast dimension; successively, in the secondary cooling zone, the cast steel is usually water-cooled and solidified thereby, and then said steel is withdrawn by multi pairs of withdrawing rolls. In such a process, one example that shows the composition is segregated in cross section of the cast piece is as shown in FIG. 1, wherein chemical composition of the steel was; C: 0.13 percent, Si: 0.22 percent, Mn: 0.62 percent, P: 0.013 percent, S: 0.017 percent, and Al: 0.007 percent. Further, the dimension of said steel was 200 × 600mm$^2$ as indicated in FIG. 1. The employed continuous casting machine is one of the curved type having 8m radius of curvature.

As is clear from FIG. 1, there are segregated a great amount of C and S in the center of the sample cross section. When this type of slab is rolled into a required dimention of plate, there appears segregating line along the center line in the cross section of the plate which causes an abnormal phenomenon in mechanical test of said steel such as crack along the center line. Such methods for eliminating those center segregation and/or center porosity as disclosed in the Japanese Patent Publn. Nos. 38899/71 and 43457/71, have been proposed, and they tried to eliminate the above mentioned defects by a considerable reduction of at least 10 percent in the cross section in the former or by complete reduction at the stage wherein the liquidus portion in casting reaches 5 – 30mm and said portion is caused to be eliminated thereby. However, even if these methods can cause said segregation and/or said porosity to disappear, it has been confirmed that they cause cracks 3 as shown in FIG. 2 on the portion between the liquidus and the solidus surface when actually put into use. That is to say, when the cast piece containing the unsolidified portion 2 is subjected to reduction as above mentioned by reduction rolls 4, 4, there appear such cracks 3 as shown in the drawings at the neighborhood of said surfaces; therefore the liquid metal concentrated by impurities enters into said cracks and remains in the form of said segregation line. According to the many experiments, especially, the latter reveals that the desired reduction rate is not always obtainable by said reducing rolls, because the end of the crater is not at a constant location. For instance, the latter art states that a reduction of at least 20 percent in cross section is aimed by a pair of rolls. However, such an extreme reduction always results in internal cracks 3 as aforementioned and they are not closed again.

Although both methods give the impression that the cast piece has been free from the producing of said center segregation and/or said center porosity, the above defects actually remain and it is impossible to obtain a sound solidification structure.

The present invention eliminates the above mentioned disadvantages and defects of the prior art. The fundamental construction of the present invention is such that the crater end of the cast piece is subjected to a reduction where the cross section is reduced by no more than 1.5 percent by each pair of rolls arranged at the withdrawing zone.

An object of the present invention is to provide a continuous casting process serving to eliminate the internal defects as center segregation and/or center porosity.

Another object of the present invention is to provide a continuous casting process not producing any cracks.

Other advantages and objects will be apparent from the following description and with the accompanying drawings in which.

Figure 3:
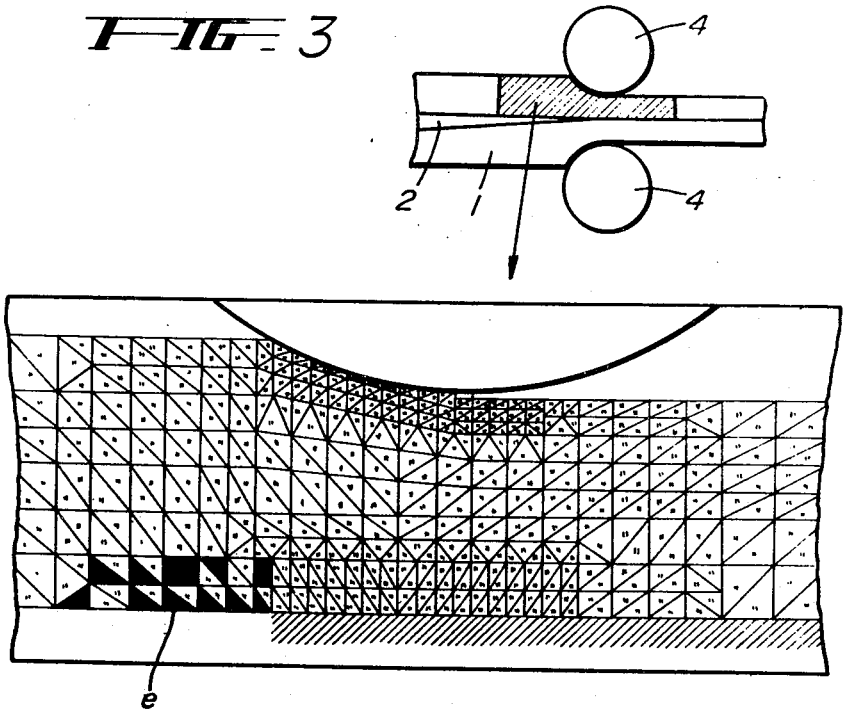
FIG. 3 is an explanatory diagram analyzing the producing of crack depending upon reduction near solidification point by the finite factor method.
Figure 4:
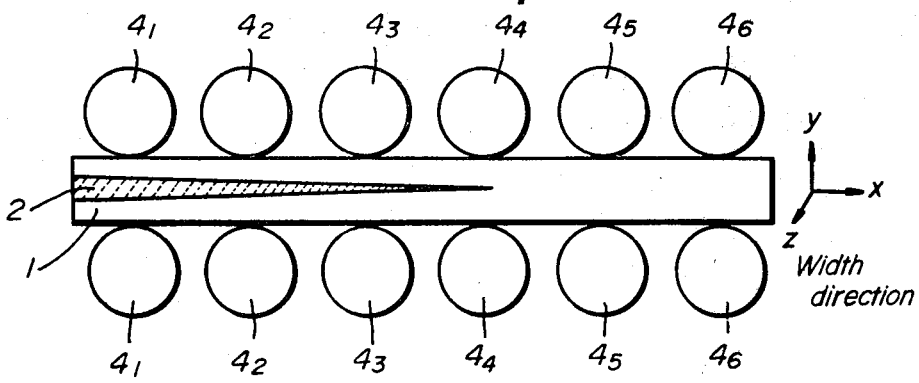
FIG. 4 is an explanatory model for calculating internal stress and strain in a continuously cast slab.

A crack at the solidifying boundary is produced as follows. That is when the front end of the solidified portion is to be reduced by 10 percent, the work conditions are set in the following manner: viz. the diameter of reduction rolls: 480mm, slab thickness: 220mm, a number of trigonometric factors based on the finite factor method: 582 (longitudinal direction 5,500mm). The producing manner of cracks near solidifying point caused by reduction is as shown in FIG. 3. It was confirmed that cracks, which are indicated as the black (e), are caused by the tensile stress in the longitudinal direction by reduction. Using the finite factor method with three dimensions a model was made up by arranging reduction rolls $\mathbf{4}_1$ to $\mathbf{4}_6$ of 480mm diameter with an interval of 600mm therebetween and performing reduction at rolls of $\mathbf{4}_1$ to $\mathbf{4}_4$, as shown in FIG. 4, and the investigation was carried out under the following conditions.

Table I

| Items | three dimensionals model model A | model B |
|---|---|---|
| Width of slab (mm) | 1600 | 1600 |
| Thickness of slab (mm) | 220 | 220 |
| Length of slab (mm) | 4500 | 2000 |
| Vertical distance from meniscus (m) | 10 | 10 |
| Divided factor (direction X) | 20 | 20 |
| Divided factor | | |

Table I-continued

| Items | three dimensionals model model A | model B |
|---|---|---|
| (direction Y) | 3 | 3 |
| Divided factor (direction Z) | 6 | 6 |
| Total number of factors | 368 | 368 |
| Temperature distribution (direction Y) | 800–1200°C | 800–1200°C |

Figure 9:
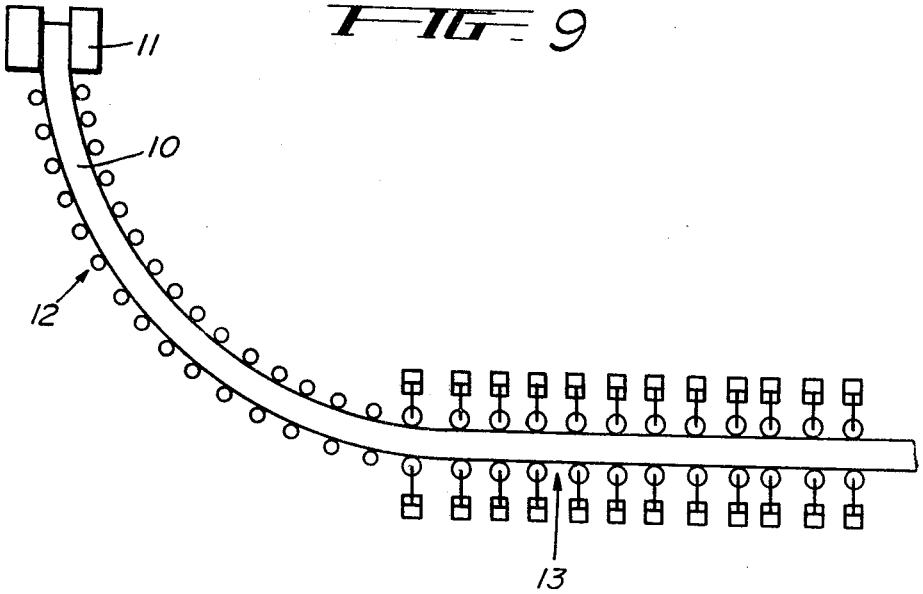
FIG. 9 is an explanatory view of a continuous casting machine for putting the present invention process into practice.

In Table I, the vertical distance from meniscus is set at 10m, as the reduction at the horizontal portion of a continuous casting machine of the curved type as shown in FIG. 9 is employed and the height from the bath surface in the mold to the cast piece at the horizontal part is set at 10m.

Figure 5:
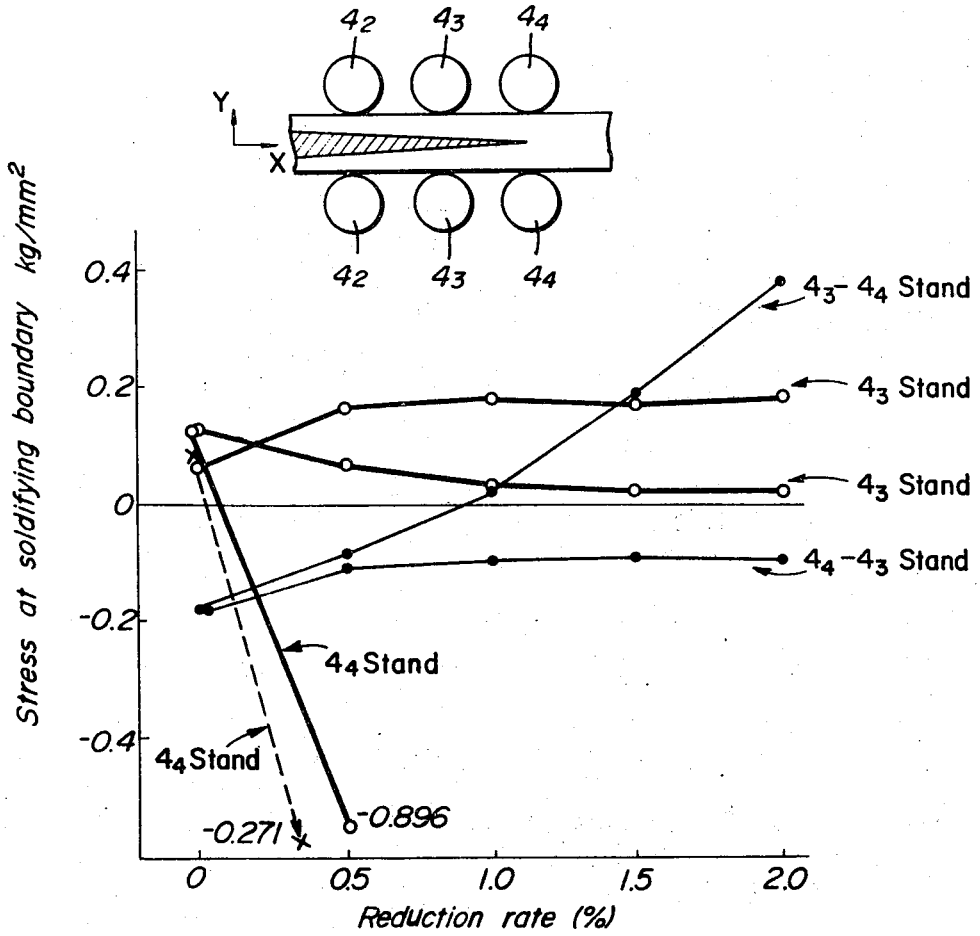
FIG. 5 is a graph showing the relation between reduction rate and stress on the solidification boundary.

The result of the investigation as above outlined and the stress in the travelling direction(X) of slab reduced by the adjacent four pairs of rolls is as shown in FIG. 5. In the case of reducing rate of less than 1.5 percent, the maximum value of the stress delta $x$ is less than 0.2kg/mm$^2$ which is approximately the same to the maximum stress value in the case of no reduction. Under the condition of no more than 1.5 percent reduction, it is clear that no cracks appear even with other conditions such as abrasion of rolls, thermal expansion and other unfavorable conditions in the normal operations. Thus, the cracks were confirmed not appearing at the reduction rate of no more than 1.5 percent even when the stress between the ($i$) stand — the ($i$+1) in the roll stand shown in FIG. 4 increased rapidly.

Figure 6:
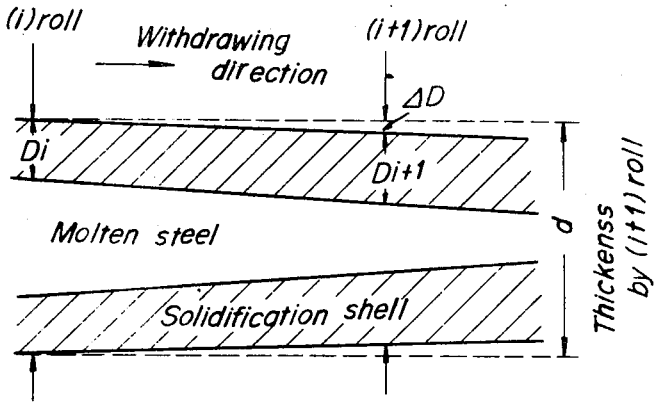
FIG. 6 is an explanatory view showing solidifying shrinkage of a continuously cast slab.

Next, the investigation was carried out on the causes for such defects as center segregation and center porosity at the cast piece cross section, and it was found out that the degree of said segregation becomes bigger as the drawing speed is incremented, if other casting conditions remain unchanged. This is because the greater withdrawing speed causes a longer crater length as mentioned above, and becoming more elongated in shape; therefore, the remaining liquid steel having higher degree of said segregation (this is higher as it comes near to the finishing of solidification) present near the front of said crater enters into the shrinkage pipe accompanying with solidification and results in the producing of said segregation thereby. When the withdrawing speed is further accelerated, the crater becomes more elongated and the unsolidifed phase near the front end of said crater cannot cover the shrinkage pipes accompanying with the solidification, which becomes said center porous. Besides the producing of said shrinkage pipes, solidification shells are bulged by the static pressure of liquid steel. The amount of said bulging is determined by the design of the continuous casting machine and the operational conditions, but it sometimes becomes several millimeters in the direction of thickness. In this case, the inflow of residual molten steel which was formed by the concentrated impurities as in the case of solidification shrinkage pipes is seen and becomes the cause of said central segregation. Said center segregation and/or central porosity may be prevented if the above mentioned reduction by said rolls is performed and said concentrated molten steel is checked from moving at the front end of said crater end, which said concentrated molten steel appears among dendritic structure at the solidification boundary. The reduction in this case should be such that cracks would not produce inside the cast piece and that the molten steel concentrated accompanying with solidification shrinkage and the said bulging would not move toward the front end of said crater. Such reduction rate varies dependent on roll interval, shell thickness, static pressure of liquid steel, etc. and may not be determined off-handedly, but said bulging does not appear in the case of billets with small cross section, unlike the case of big sized slabs, because of lower height of continuous casting mold and comparatively thicker solidifying shell. Thus, the minimum reduction rate per one pair of rolls is equivalent to rate of solidification shrinkage producing between the pair of rolls an the pair immediately preceding it. The amount of said solidification shrinkage is shown in FIG. 6, and more particularly is equivalent to $\Delta$ D showing that solidification shell increases from D$i$ to $D(i+1)$ as the cast piece moved from ($i$)th roll to ($i$+1)th roll. Thus, the minimum reduction to be performed is obtained.

Its concrete amount varies depending also on kind of steels and is impossible to be quantitatibly given.

Figure 7:
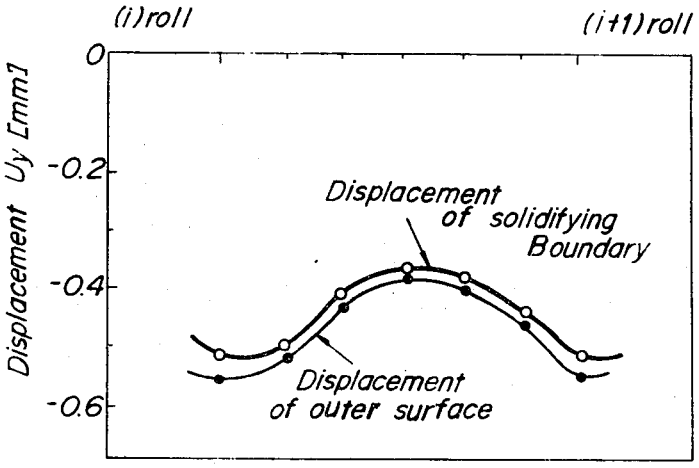
FIG. 7 is a graph showing displacement of the solidifying boundary in comparison with that of the outer surface in a case of the cast slab of 220mm subjected to 0.5 percent reduction.

As shown in FIG. 7, calculation was carried out under the conditions of Table I on how the solidification boundary change when the cast piece 1 is reduced by a pair of rolls 4,4 as in FIG. 5. According to FIG. 7, when the surface of cast piece 1 is reduced by 0.5 percent (in the cast piece of 220mm in thickness, that is corresponding to 0.55mm on one side of the said piece), the solidifcation boundary was found to change by 90 percent of its amount. In FIG. 7, the upper part of the curve indicates the bulging of said solidification shell caused by the stationary molten steel. Accordingly, it is clear that the producing of shrinkage pipes caused by the solidification of inner molten steel through said reduction may also be prevented. Generally, the position of the front end of said crater is not to be found in a predetermined position even when the operational conditions are the same. Accordingly, the above position was investigated by the method disclosed in the Japanese Patent Publication No. 21092/71, wherein a metal pin is driven into the case piece by a gun, and the solidification boundary is determined as it dissolves partially in the molten steel. The investigation confirmed that said position in the slab of 1,600 × 200mm cross section cast at the speed of 650mm/min varies within the range of 10.4 – 12.0m from the bath surface in the mold. This difference of width becomes greater as the withdrawing speed becomes faster and under normal operational conditions it is found to move within the range of 2m average in the rear and the front of the average position. Therefore in order that the reduction as afore-mentioned be carried out and the center segregation be prevented, a group of reduction rolls ranging in length of several meters exceeding this variable width should be located and be made for an optimum reduction for the portion where the position of the front end of said crater may change.

Figure 8:
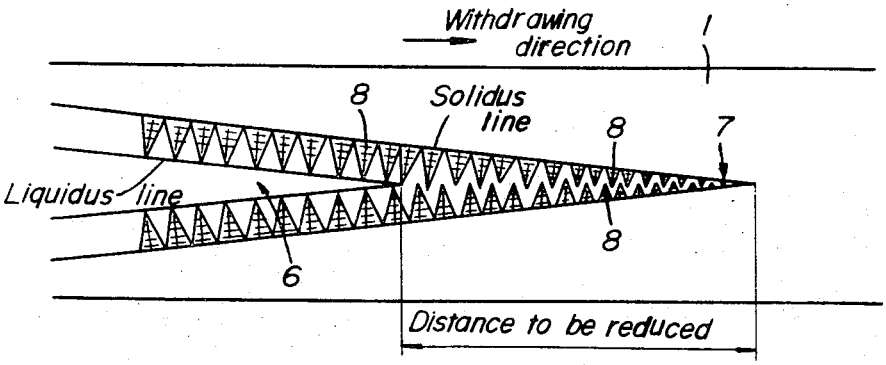
FIG. 8 shows a model of the crater end.

It is also important to consider which position of the front end of the crater and should be subjected to the above mentioned reduction. The said position happens to be in the distance sandwiched by the liquidus line and solidus line as shown in FIG. 8. Ordinary steels containing C, Mn, Si, etc. have the liquidus line and the solidus line as shown by the phase diagram. For instance, if the liquidus line is 1,520°C for the ordinary carbon steel, its solidus line is 1,480°C with a difference of about 40°C therebetween. FIG. 8 shows the liquidus line crater 6 and the solidus line crater 7 and the sandwiched portion by the craters 6 and 7 is filled with dendrite 8 or equi-axed structure which discourages the molten steel movement. On the other hand, solidification shrinkage is caused as the temperature changes from that of the liquidus line to that of the solidus line and said concentrated molten steel enter the above dendritic structure produced thereby and then the center segregation. Therefore, the scope which should be subjected to reduction is the distance d as shown in FIG. 8.

Now, a concrete embodiment of the present invention process is explained. As the cast piece 10 is withdrawn from out of the mold 11 by the means 13 comprising multipairs of the reducing rolls via the secondary cooling zone 12, the cast piece 10 is reduced by the above rolls 13 using hydraulic pressure. In such a case, the necessary power for the operation is taken from the driving motor, etc. The whole setup length of the withdrawing and reducing rolls 13 was made 11.6m so as to sufficiently cover the variable range of the position of the front end of said crater. The curve in the secondary cooling zone 12 is formed with a radius of curvature of 10.5m and the length to the curve point is 16.9m.

In such casting facilities, the slab of 250 × 2,000mm cross section was continuously cast and its solidification speed (solidus line) is $D = 27 \sqrt{t}$ (wherein $D$ is in millimeter and $t$ is in minute) in respect of its thickness direction. When the withdrawing speed is 1m/min, the front end of said crater end is among the said drawing rolls 13 and the reduction rate of 0.5 to 4mm per one roll is employed. The result of the operation was that no producing center segregation and/or no center porosity was seen in the slab cross section in either case.

Figure 1:
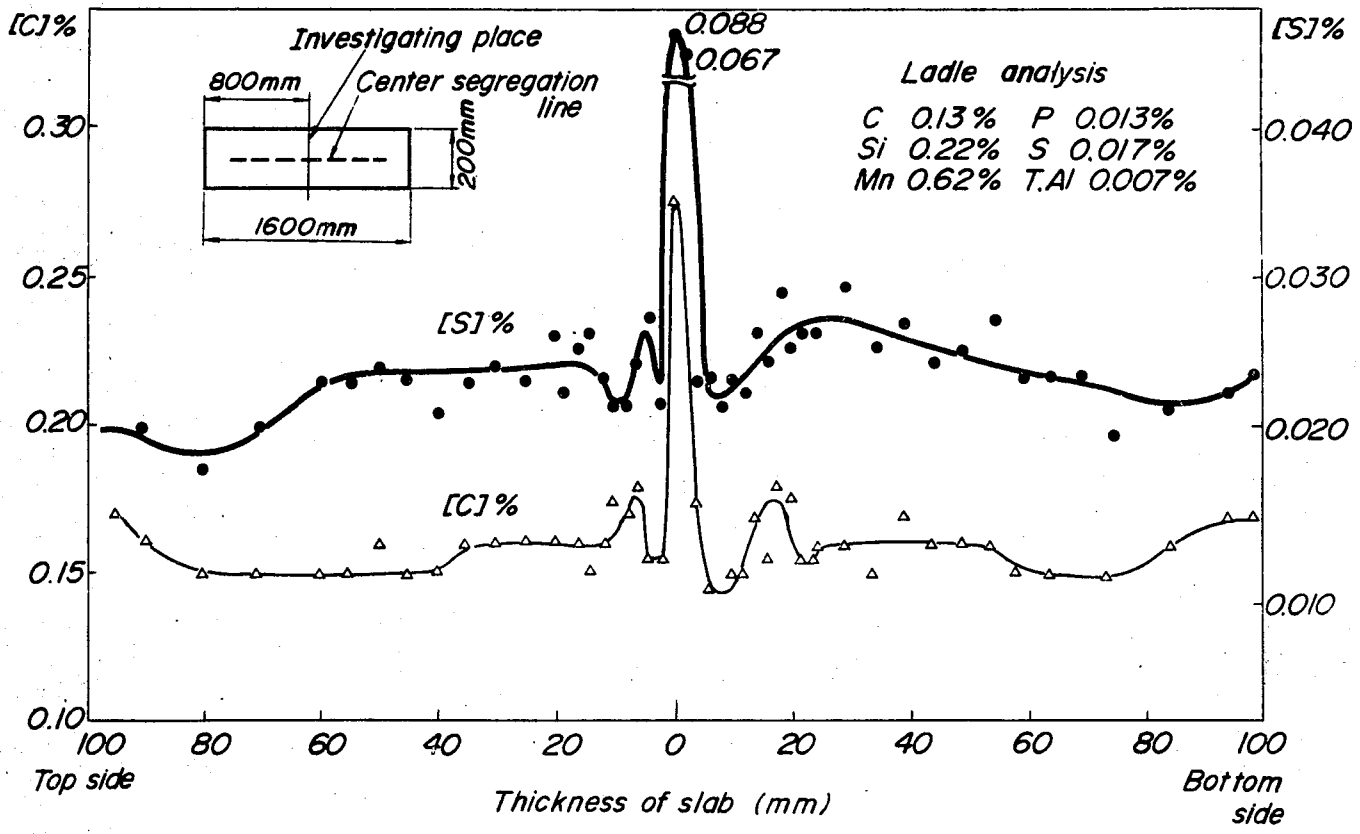
FIG. 1 is a graph showing one example of segregating manner in the thickness direction of a slab manufactured in accordance with the conventional continuous casting method.
Figure 2:
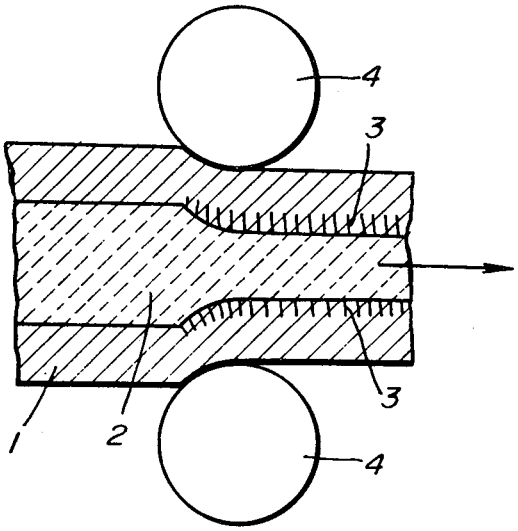
FIG. 2 is an explanatory diagram showing how the cross sectional cracks produced by a bigger reduction rate.
Figure 10:
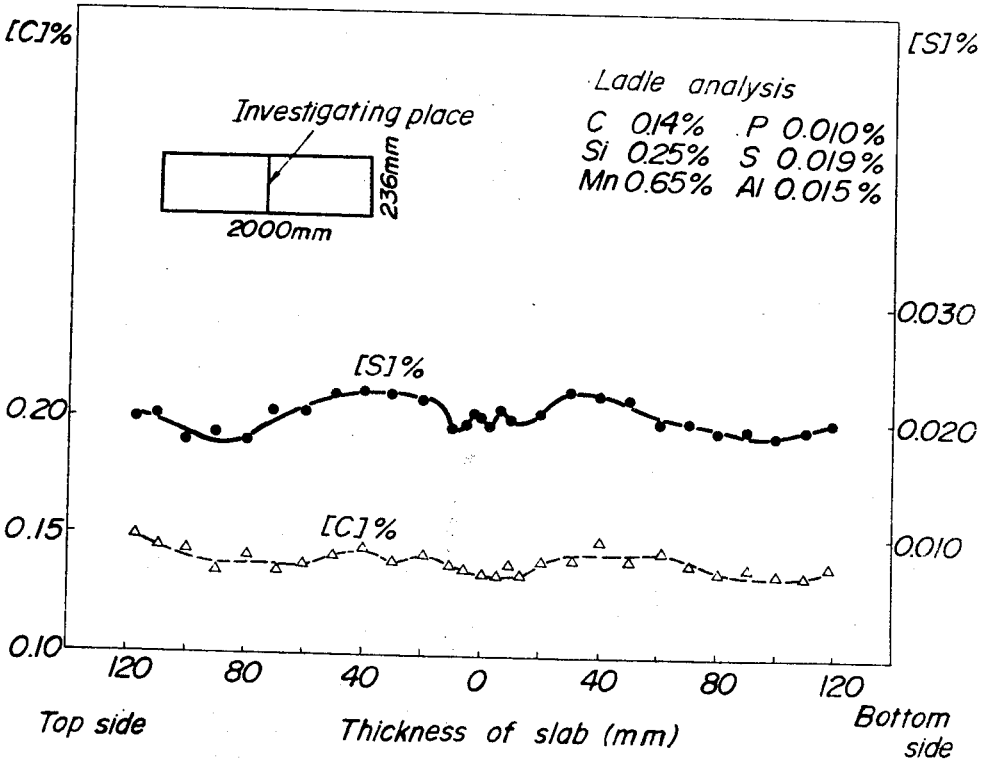
FIG. 10 is a graph showing the distributing manner of composition in the thickness direction of a slab manufactured in accordance with the present invention process.

The composition distribution in the direction of thickness of the cast piece in accordance with the present invention process is shown in FIG. 10, and it is clear that said segregation completely disappeared compared to the conventional method in FIG. 1.

Also, when the present invention process is applied to billets having small cross section, similar operational effects are possible to be obtained with ease and its application is not limited to steels alone, but it may be applied to other metals as well.

We claim:

1. In a process for manufacturing continuous cast steel, wherein said steel is cast, then cooled and then worked while still in a partially molten state by multiple pairs of withdrawing rolls arranged following said cooling stage; the improvement comprising the step of reducing, at a rate corresponding to less than 1.5 percent for each pair of said rolls at the working stage, the portion of said steel sandwiched between the liquidus line and the solidus line at the front end of a crater which is produced as the liquidus part is solidified.

* * * * *